US008485008B2

(12) United States Patent
Hall

(10) Patent No.: US 8,485,008 B2
(45) Date of Patent: Jul. 16, 2013

(54) AUTOMOTIVE KEY FOB HAVING AN ANTI KEY RATTLE SPRING

(75) Inventor: Scott A. Hall, Rochester Hills, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 13/046,305

(22) Filed: Mar. 11, 2011

(65) Prior Publication Data

US 2011/0219831 A1 Sep. 15, 2011

Related U.S. Application Data

(60) Provisional application No. 61/312,917, filed on Mar. 11, 2010.

(51) Int. Cl.
*A47G 29/10* (2006.01)

(52) U.S. Cl.
USPC ..... 70/456 R; 70/459; 206/37.3

(58) Field of Classification Search
USPC ..... 206/37.3, 37.1, 37.4, 38.1, 37.2, 206/37.5, 37.6, 37.7, 37.8; 70/456 R, 459, 70/457, 458; 24/3.6
See application file for complete search history.

(56) References Cited

U.S. PATENT DOCUMENTS

| | | | | | |
|---|---|---|---|---|---|
| 1,438,336 | A * | 12/1922 | Schroeder | 70/493 |
| 1,649,402 | A * | 11/1927 | Gildemeister | 70/457 |
| 2,008,398 | A * | 7/1935 | Mangan | 70/456 R |
| 2,173,008 | A * | 9/1939 | Cheney | 70/456 R |
| 2,387,319 | A * | 10/1945 | Evans | 70/456 R |
| 2,400,221 | A * | 5/1946 | Bennett | 70/456 R |
| 2,490,396 | A * | 12/1949 | Leff | 70/456 R |
| 2,517,500 | A * | 8/1950 | McPherson et al. | 70/456 R |
| 2,690,666 | A * | 10/1954 | Engel et al. | 70/456 R |
| 2,694,244 | A * | 11/1954 | Nolan | 24/650 |
| 2,789,613 | A * | 4/1957 | Corsaw | 206/37.2 |
| 3,287,945 | A * | 11/1966 | Yulkowski | 70/493 |
| 3,349,589 | A * | 10/1967 | Fricke | 70/395 |
| 3,587,262 | A * | 6/1971 | Kaye | 70/456 R |
| 4,320,638 | A * | 3/1982 | Dunphy et al. | 70/358 |
| 4,325,242 | A * | 4/1982 | Tietz | 70/401 |
| 4,348,881 | A * | 9/1982 | Toyoda | 70/456 R |
| 4,454,737 | A * | 6/1984 | Toyoda | 70/456 R |
| 4,852,374 | A * | 8/1989 | Gotanda | 70/456 R |
| 5,051,724 | A * | 9/1991 | Morrow et al. | 340/568.1 |
| 5,215,190 | A * | 6/1993 | Hoffpauir, Jr. | 206/37.2 |
| 5,310,101 | A * | 5/1994 | Park et al. | 224/163 |
| 5,475,548 | A * | 12/1995 | Rudi et al. | 360/96.51 |
| 6,145,357 | A * | 11/2000 | Stefanescu | 70/406 |
| 6,209,370 | B1 * | 4/2001 | Larson et al. | 70/389 |
| 6,672,118 | B1 * | 1/2004 | Wright | 70/459 |
| 7,032,419 | B2 * | 4/2006 | Booker | 70/456 R |
| 2007/0044525 | A1 * | 3/2007 | Katagiri et al. | 70/459 |
| 2008/0072638 | A1 * | 3/2008 | Rooker | 70/456 R |
| 2009/0244824 | A1 | 10/2009 | Goemmel et al. | |
| 2011/0203337 | A1 * | 8/2011 | Booker | 70/456 R |

* cited by examiner

*Primary Examiner* — Lloyd Gall

(57) ABSTRACT

An automotive key fob includes a leaf-style spring positioned within the key fob so that, while a removable key is inserted into the key fob, the removable key engages, and at least partially collapses, the spring thereby reducing movement of the key within the key fob and thereby reducing noise associated with movement of the key within the key fob. The leaf-style spring may be positioned in a spring-surrounding pocket within an external housing of the key fob. The spring-surrounding pocket may be at least partially defined by a wall having a height that is less than a height of the leaf-style spring while the spring is installed within the key fob.

12 Claims, 2 Drawing Sheets

AUTOMOTIVE KEY FOB HAVING AN ANTI KEY RATTLE SPRING

CROSS-REFERENCE TO RELATED APPLICATIONS

This non-provisional patent application claims priority to the benefit of U.S. provisional application Ser. No. 61/312,917, entitled Anti Key Rattle Spring, which was filed on Mar. 11, 2010, and which is incorporated, in its entirety, herein by reference.

BACKGROUND

Embodiments of the invention relate generally to key fobs and more particularly to key fobs that include an anti key rattle spring.

A key fob is typically a decorative and/or useful item that people carry with their keys, on a key ring or a key chain, for various purposes, including, but not limited to ease of tactile identification, to provide a better grip, to make a personal statement, for activating such things as remote keyless entry systems on motor vehicles, and the like.

Keys may be inserted into certain types of key fobs, and such keys may cause irritating noises, for example, rattling noises, when the key fobs are moved in various ways, such as shaking.

Techniques for reducing and/or eliminating such noises would, therefore, advance the art.

BRIEF SUMMARY

An automotive key fob includes a leaf-style spring positioned within the key fob so that, while a removable key is inserted into the key fob, the removable key engages, and at least partially collapses, the spring thereby reducing movement of the key within the key fob and thereby reducing noise associated with movement of the key within the key fob. The leaf-style spring may be positioned in a spring-surrounding pocket within an external housing of the key fob. The spring-surrounding pocket may be at least partially defined by a wall having a height that is less than a height of the leaf-style spring while the spring is installed within the key fob.

DETAILED DESCRIPTION

Figure 1:
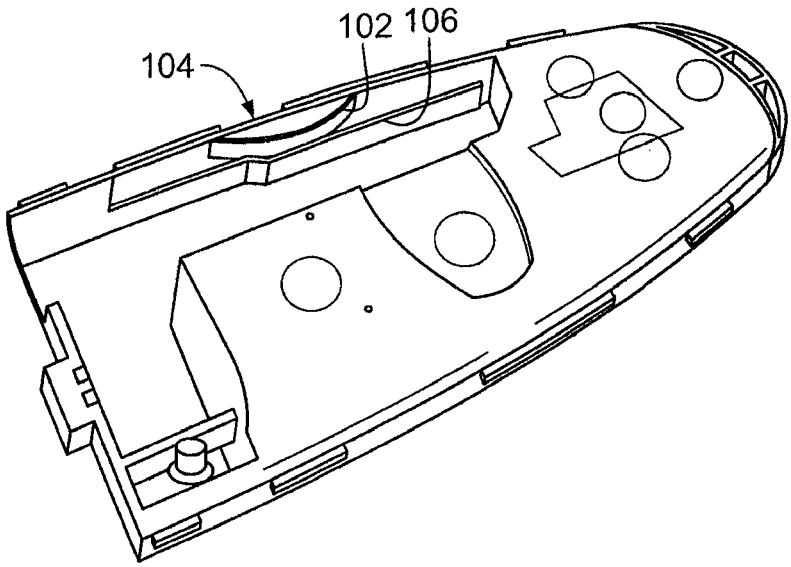
FIG. 1 shows an automotive key fob with a leaf-style spring in the key fob in accordance with embodiments of the invention.

FIG. 1 shows an automotive key fob with a leaf-style spring in the key fob in accordance with embodiments of the invention. By using a leaf-style spring 102 to apply pressure to a removable key 202 in an automotive key fob 104, movement of the removable key is reduced and/or eliminated. This, in turn, reduces and/or eliminates the audible noise, or rattle, when the key fob is shaken, advantageously giving the key fob a much more solid, higher-quality feel. Tension from installing the spring into a surrounding pocket 106 retains the spring in place within the key fob. The surrounding pocket may be at least partially defined by a wall having a height that is less than the height of the spring 102 when the spring is installed in the key fob 104. This height differential allows the removable key 202 to engage the spring 102 while the key is inserted into the key fob 104. The spring 102 may then be covered by a second half of an external housing of the key fob (not shown), thereby trapping the spring in place to prevent the spring from coming out of the key fob 104 during normal use. No additional fasteners, tapes, or adhesives are required for installation of the spring 102 into the key fob 104.

Figure 2:
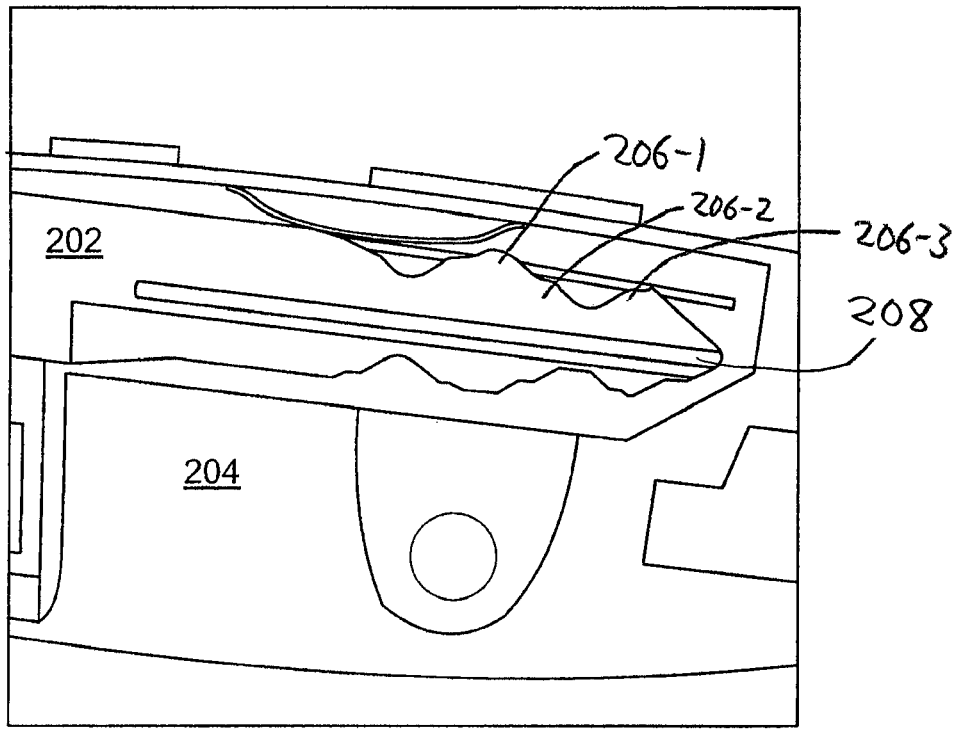
FIG. 2 shows the leaf-style spring in a collapsed position caused by a removable key being installed in the key fob in accordance with embodiments of the invention.

FIG. 2 shows the leaf-style spring 102 in an at least partially collapsed position caused by a removable key 202 being installed in the key fob in accordance with embodiments of the invention. Key 202 may have features such as key teeth 206-1, 206-2, and 206-3; a key groove 208; and other features.

Figure 3:
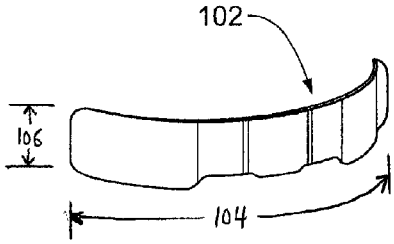
FIG. 3 is an enlarged view of the leaf-style spring in accordance with embodiments of the invention.

FIG. 3 is an enlarged view of the leaf-style spring in accordance with embodiments of the invention. Tension resulting from installing the spring 102 into the packet 106 holds the spring in place for assembly of the external housing 204 of the key fob. The spring is then covered by the external housing (only one half of which is shown in FIGS. 1 and 2), thereby trapping the spring in place to prevent the spring from coming out during normal use. No additional fasteners or adhesives are used for installation. A length 104 of the spring and a height 106 of the spring are shown in FIG. 3.

Figure 4:
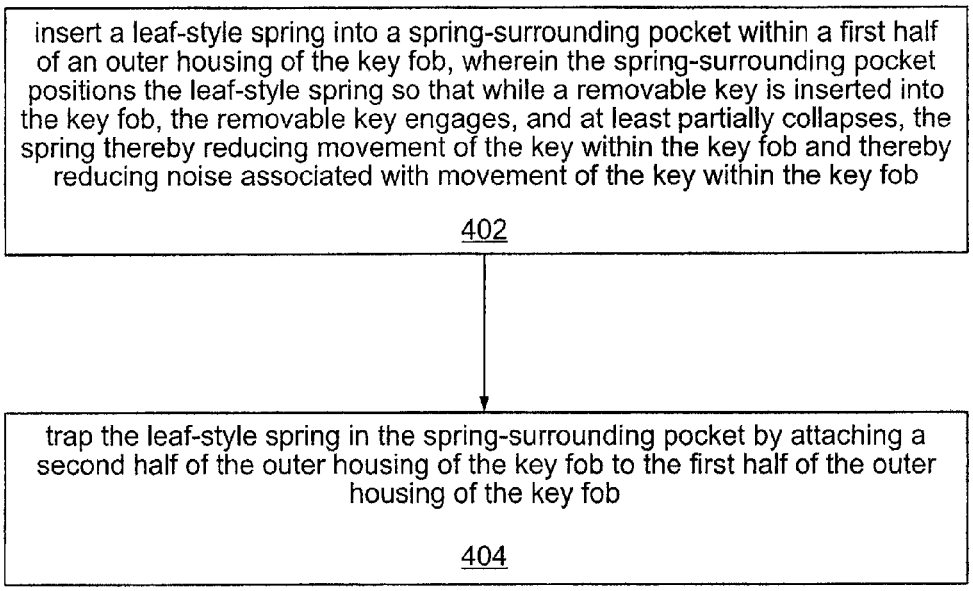
FIG. 4 is a flow chart showing steps for assembling an automotive key fob in accordance with embodiments of the invention.

FIG. 4 is a flow chart showing steps for assembling an automotive key fob in accordance with embodiments of the invention. As shown at 402, a leaf-style spring may be inserted into a spring-surrounding pocket within a first half of an outer housing of the key fob, wherein the spring-surrounding pocket positions the leaf-style spring so that, while a removable key is inserted into the key fob, the removable key engages, and at least partially collapses, the spring thereby reducing movement of the key within the key fob and thereby reducing noise associated with movement of the key within the key fob. As shown at 404, the leaf-style spring may then be trapped in the spring-surrounding pocket by attaching a second half of the outer housing of the key fob to the first half of the outer housing of the key fob.

The foregoing description is for illustration purposes only. The scope of the invention is defined by the claims.

The invention claimed is:

1. Apparatus comprising:

a key fob;

a removable key having a key-shaft portion, the key-shaft portion having longitudinally arranged key teeth formed into a key-teeth surface of the key-shaft portion, and the key-shaft portion having at least one key groove formed into a key-groove surface of the key-shaft portion, the at least one key groove being aligned parallel to a longitudinal axis of the key-shaft portion, and the key-groove surface being different from, adjacent to, and perpendicular to the key-teeth surface; and a leaf-style spring positioned within the key fob so that, while the key-shaft portion of the removable key is longitudinally inserted into the key fob, the key-teeth slide along a middle portion of the spring and at least partially collapse the spring, thereby reducing movement of the key-shaft portion of the removable key within the key fob and thereby reducing noise associated with movement of the key-shaft portion of the removable key within the key fob.

2. The apparatus of claim 1, wherein the leaf-style spring is positioned in a spring-surrounding pocket within an external housing of the key fob.

3. The apparatus of claim 2, wherein the spring-surrounding pocket is at least partially defined by a wall having a height that is less than a height of the leaf-style spring while the spring is installed within the key fob.

4. The apparatus of claim 2, wherein an entire length of the leaf-style spring is positioned in the spring-surrounding pocket.

5. The apparatus of claim 2, wherein the leaf-style spring is at least partially compressed within the spring-surrounding pocket, thereby creating a force that, without additional fasteners or adhesives, retains the leaf-style spring within the spring-surrounding pocket.

6. The apparatus of claim 3, wherein the wall of the spring-surrounding pocket has a height that is less than a height of the leaf-style spring while the spring is installed within the key fob such that the wall of the spring-surrounding pocket at least partially defines an aperture through which the key-teeth surface of the removable key engages the leaf-style spring.

7. Apparatus comprising:

key fob means;

removable key means having a key-shaft portion, the key-shaft portion having longitudinally arranged key teeth formed into a key-teeth surface of the key-shaft portion, and the key-shaft portion having at least one key groove formed into a key-groove surface of the key-shaft portion, the at least one key groove being aligned parallel to a longitudinal axis of the key-shaft portion, and the key-groove surface being different from, adjacent to, and perpendicular to the key-teeth surface; and leaf-style spring means positioned within the key fob means so that, while the key-shaft portion of the removable key means is longitudinally inserted into the key fob means, the key-teeth slide along a middle portion of the spring and at least partially collapse the spring means, thereby reducing movement of the key-shaft portion of the removable key means within the key fob means and thereby reducing noise associated with movement of the key-shaft portion of the removable key means within the key fob means.

8. The apparatus of claim 7, wherein the leaf-style spring means is positioned in a spring-surrounding pocket within an external housing of the key fob means.

9. The apparatus of claim 8, wherein the spring-surrounding pocket is at least partially defined by a wall having a height that is less than a height of the leaf-style spring means while the spring means is installed within the key fob means.

10. The apparatus of claim 8, wherein an entire length of the leaf-style spring means is positioned in the spring-surrounding pocket.

11. The apparatus of claim 8, wherein the leaf-style spring means is at least partially compressed within the spring-surrounding pocket, thereby creating a force that, without additional fasteners or adhesives, retains the leaf-style spring means within the spring-surrounding pocket.

12. The apparatus of claim 9, wherein the wall of the spring-surrounding pocket has a height that is less than a height of the leaf-style spring means while the spring means is installed within the key fob means such that the wall of the spring-surrounding pocket at least partially defines an aperture through which the key-teeth surface of the removable key means engages the leaf-style spring means.

* * * * *